US006221215B1

(12) United States Patent
Halmschlager et al.

(10) Patent No.: US 6,221,215 B1
(45) Date of Patent: Apr. 24, 2001

(54) SUCTION DEVICE AND PROCESS FOR CONDITIONING AND/OR DRAINAGE OF AN ENDLESS FELT

(75) Inventors: Günter Halmschlager, Krems; Peter Haider, St. Pölten; Franz Stelzhammer, Böheimkirchen, all of (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/277,750

(22) Filed: Mar. 29, 1999

(30) Foreign Application Priority Data

Mar. 27, 1998 (DE) ..... 198 13 772

(51) Int. Cl.[7] ..... D21F 3/10; D21F 1/48; D21F 11/00

(52) U.S. Cl. ..... 162/374; 162/352; 162/217; 162/363; 162/354; 162/351; 162/366

(58) Field of Search ..... 162/217, 363, 162/374, 354, 352, 351, 366

(56) References Cited

U.S. PATENT DOCUMENTS

| | | | |
|---|---|---|---|
| 1,236,359 | | 8/1917 | Reynolds . |
| 3,052,296 | | 9/1962 | Justus . |
| 3,218,228 | | 11/1965 | Wagenknecht . |
| 3,859,163 | | 1/1975 | Haythornthwaite . |
| 4,909,906 | * | 3/1990 | Bartelmuss et al. ..... 162/374 |
| 5,147,508 | | 9/1992 | Sweet . |

FOREIGN PATENT DOCUMENTS

| | | |
|---|---|---|
| 306498 | 4/1973 | (AT) . |
| 355412 | 3/1980 | (AT) . |
| 392303 | 3/1991 | (AT) . |
| 2641115 | 6/1977 | (DE) . |
| 7833942 | 2/1979 | (DE) . |
| 4322320 | 11/1993 | (DE) . |
| 4305493 | 8/1994 | (DE) . |

* cited by examiner

*Primary Examiner*—Stanley S. Silverman
*Assistant Examiner*—Dionne A. Walls
(74) *Attorney, Agent, or Firm*—Greenblum & Bernstein, P.L.C.

(57) ABSTRACT

Suction device and process for at least one of conditioning and drainage of an endless felt. The device includes a housing having at least one vacuum chamber, and a plurality of suction slits located on a suction surface of the housing that is adapted to face the endless felt. The plurality of suction slits are oriented to extend at least one of in and obliquely to a travel direction of the endless felt. The process includes guiding the endless belt over a suction surface of a vacuum chamber, and suctioning a surface of the endless belt with a plurality of suction slits located in the suction surface of the vacuum chamber. The plurality of suction slits extend in a direction that is at least one of in and oblique to a belt travel direction.

40 Claims, 2 Drawing Sheets

SUCTION DEVICE AND PROCESS FOR CONDITIONING AND/OR DRAINAGE OF AN ENDLESS FELT

CROSS-REFERENCE TO RELATED APPLICATIONS

The present application claims priority under 35 U.S.C. § 119 of German Patent Application No. 198 13 772.9 filed Mar. 27, 1998, the disclosure of which is expressly incorporated by reference herein in its entirety.

BACKGROUND OF THE INVENTION

1. Field of the Invention

The present invention relates to a suction device and process for conditioning and/or drainage of an endless felt in web producing machine, e.g., a paper and/or cardboard machine. The suction device includes a housing having at least one vacuum chamber, and the at least one vacuum chamber includes, on a side facing the endless felt, at least one suction slit. Further, the endless felt is guided over the at least one suction slit.

2. Discussion of Background Information

A suction device similar to the device generally discussed above is disclosed in DE-A-43 05 493, in which a continuous suction slit is provided that extends crosswise to the direction of travel of the felt. While this known suction device has proven itself in practice in many respects, it is disadvantageous in that only a limited slit width is possible. Further, even with relatively small slit widths, an unwanted drawing-in of the felt may occur. Also, with the limited slit width, the conditioning length over which, or a dwelling time during which, a respective felt region can be exposed to suction or conditioned is limited.

SUMMARY OF THE INVENTION

The present invention provides a suction device of the type generally discussed above in which the danger of an unwanted drawing-in of the felt is reduced to a minimum and, at the same time, longer dwelling times are possible for the felt conditioning and/or drainage.

In this regard, the present invention provides a housing having a suction surface adapted to face the felt, and a plurality of suction slits formed in the suction surface that extend in at least one of in and obliquely to a travel direction of the felt.

In accordance with the features of the present invention, optimum support of the felt is substantially always guaranteed, even with relatively long slit lengths. In particular, the felt rests on a support surface formed by regions lying between individual suction slits. Since the suction slits do not extend crosswise to the felt travel direction, but rather generally in the direction of travel of the felt, the resultant suction region may be lengthened in the direction of travel of the felt without consequently increasing the danger of an unwanted drawing-in of the felt. In this manner, substantially longer dwelling times are possible for the felt conditioning and/or drainage. Because a large number of separate suction slits are utilized, the slit width may be selected to be virtually as small as desired without negatively affecting the suction capability. An appropriate number of slits must merely be provided. In accordance with the arrangement of the present invention, virtually every section of the felt that is exposed to a respective suction slit is supported on the suction surface of the vacuum chamber. Thus, even with a relatively large number of slits, the danger of a drawing-in of the felt is virtually eliminated. Moreover, generally, only one suction device is necessary for one felt. Thus, the number of vacuum lines, of bearing blocks, and/or the like may be reduced. Thus, space requirement is also correspondingly smaller. Preferably, the surfaces in contact with the felt may be manufactured from a wear-resistant material, e.g., ceramic, of non-wear-resistant material, e.g., plastic, or combinations thereof.

It may be preferable to provide at least some suction slits that have a variably adjustable length. In this manner, the lengths of at least some of the suction slits may be separately adjustable. With adjustable slit lengths, the dwelling times for felt conditioning and/or draining may also be adjustable. Accordingly, effective conditioning and/or draining length of the suction slits may be adjustable during operation and/or while the machine is shut off.

The suction slits may be oriented in the direction of travel of the felt. However, it is also conceivable that at least some of the suction slits may be arranged to run obliquely to the direction of travel of the felt. Further, the obliquely extending suction slits may be arranged in mirror symmetry with a median plane of the felt extending in the direction of travel of the felt. With such an arrangement of the suction slits, a broad-drawing effect may be simultaneously obtained. Further, with such oblique suction slits, care must be taken that the various felt regions are adequately and uniformly conditioned so as to avoid streak formation.

In an exemplary embodiment, at least some of the suction slits may be located near each other in at least one group that extends at least substantially straight over at least a part of a width of the felt. Alternatively or additionally, at least some of the suction slits may also be located in at least one group which extends obliquely over at least a part of the width of the felt.

In another exemplary embodiment of the suction device of the present invention, at least some of the suction slits may be located in at least two groups successively arranged with respect to each other in the direction of travel of the felt.

In particular, two groups of successively located slits may be arranged such that each group extends at least substantially straight over at least substantially an entire width of the felt.

In another embodiment, at least some of the suction slits may be located into at least one pair of groups, in which the groups of slits extend obliquely over at least substantially one-half the width of the felt and are arranged in mirror symmetry relative to a median plane perpendicular to the felt and extending in the direction of travel of the felt. In this case, at least two pairs of groups of slits successively arranged relative to each other in the direction of travel of the felt are provided, i.e., one pair on each side of the median plane. Further, the respective groups of slits extending obliquely on a same side of the median plane may be arranged parallel to each other.

It may be preferable if the suction slits of groups of slits successive to each other are offset relative to the adjacent group generally crosswise to the direction of travel of the felt. Further, it may be preferable to locate the suction slits in gaps between toothed elements.

According to another exemplary embodiment of the present invention, at least two groups of slits may be successively (consecutively) arranged in the felt travel direction. The suction slits may be positioned in gaps defined between two comb-like diaphragms whose teeth extend in the felt travel direction, and which are offset from each other generally crosswise to the felt travel direction so as to preferably mesh with each other. At least one of the comb-like diaphragms can be adjustable in the direction of travel of the felt and relative to a stationary part of the housing. It may also be preferable if at least one comb-like diaphragm is subdivided crosswise to the felt travel direction into a plurality of segments composed of one or a plurality of teeth. Further, at least some of these diaphragm segments may be adjustable in the felt travel direction relative to the stationery part of the housing, and the diaphragm segments may be at least partially separately adjustable.

The housing containing at least one vacuum chamber may be generally formed, e.g., as tube-shaped and extend crosswise to the direction of travel of the felt at least substantially over the entire width of the felt.

In another exemplary embodiment, the housing may include only one vacuum chamber. In this manner, the vacuum chamber may extend at least substantially over the entire width of the felt.

The present invention is directed to a suction device for at least one of conditioning and drainage of an endless felt. The device includes a housing having at least one vacuum chamber, and a plurality of suction slits located on a suction surface of the housing that is adapted to face the endless felt. The plurality of suction slits are oriented to extend at least one of in and obliquely to a travel direction of the endless felt.

The present invention is directed to a process for at least one of draining and conditioning an endless belt. The process includes guiding the endless belt over a suction surface of a vacuum chamber, and suctioning a surface of the endless belt with a plurality of suction slits located in the suction surface of the vacuum chamber. The plurality of suction slits extend in a direction that is at least one of in and oblique to a belt travel direction.

In accordance with another feature of the present invention, the process further includes adjusting a length of at least some of the plurality of suction slits.

In accordance with another feature of the present invention, the plurality of suction slits may be arranged in a least two rows that extend across a width of the vacuum chamber, and the process may further include successively suctioning the endless belt in each of the at least two rows.

According to still another feature of the present invention, the plurality of suction slits may be arranged in a least two rows that extend across a width of the vacuum chamber, and the suction slits of each row may be positionally offset in a direction crosswise to the belt travel direction from the slits of the suction slits of an adjacent row. The process may further include successively suctioning the endless belt in each of the at least two rows.

In a further feature of the present invention, the plurality of suction slits may be formed by at least two comb-shaped elements, which are interlaced so that teeth of one of the at least two comb-shaped elements are positioned in gaps of an adjacent comb-shaped element, and the process may further include successively suctioning the endless belt in each of the at least two rows. Further, the process may include adjusting the position of the at least one of the comb-shaped elements relative to the adjacent comb-shaped element. In this manner, a slit length of at least some of the plurality of suction slits may be adjusted.

According to a still further feature of the present invention, the suctioning of the surface of the endless belt with a plurality of suction slits may be provided through a plurality of suction slits arranged obliquely to the travel direction of the belt.

According to another feature of the present invention, the suctioning of the surface of the endless belt with a plurality of suction slits may be provided through a plurality of suction slits arranged obliquely to the travel direction of the belt, and the plurality of suction slits may be arranged in mirror symmetry relative to a center line of the suction surface that extends in the travel direction.

In accordance with yet another feature of the present invention, the suctioning of the surface of the endless belt with a plurality of suction slits may be provided through a plurality of suction slits arranged obliquely to the belt travel direction of the belt, and the plurality of suction slits may be arranged in mirror symmetry relative to a center line of the endless belt that extends in the travel direction.

The present invention is also directed to a suction device for at least one of conditioning and drainage of an endless felt in a web producing machine. The device includes a housing extending across a machine width that is composed or at least one vacuum chamber, and a plurality of suction slits located on a suction surface of the housing. The plurality of suction slits are oriented to extend at least one of crosswise to and obliquely to the machine width.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
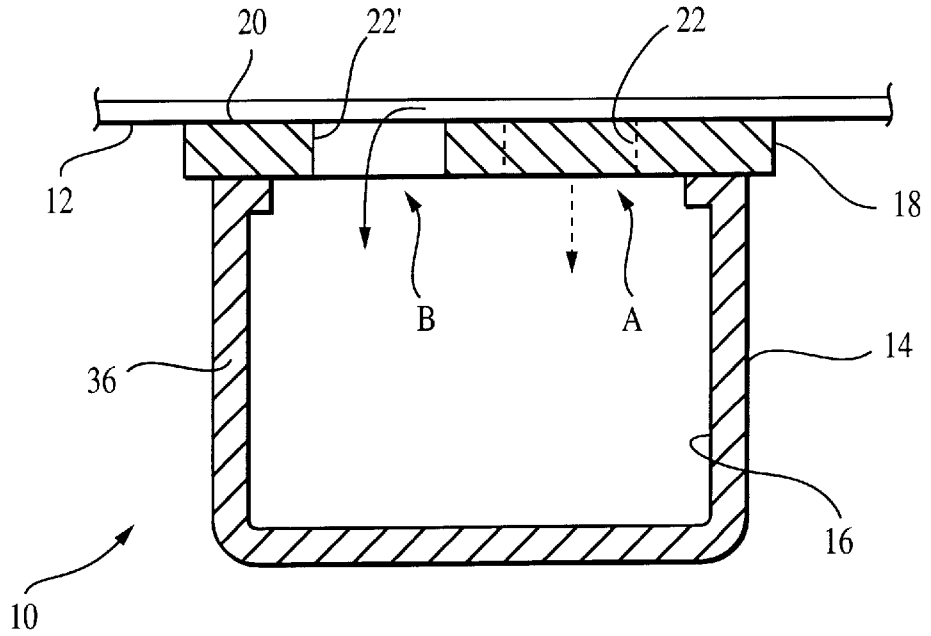
FIG. 1 schematically illustrates a partially sectional side view of an embodiment of a suction device.

FIG. 1 schematically illustrates an exemplary embodiment of suction device 10 for conditioning and/or drainage of an endless felt 12 of a web producing machine, e.g., a paper and/or cardboard machine.

Suction device 10 is composed of a tube-like housing 14 that extends crosswise to a travel direction L of felt 12 and at least substantially over the entire width of felt 12 or the width of the machine. Housing 14 may include a continuous vacuum chamber 16 that extends, at least substantially, over the entire width of the machine. Alternatively, housing 14 may include a plurality of vacuum chambers that extend across the width of the machine.

A cover 18 may be provided on a suction surface of housing 14, which is adapted to face felt 12. An outer surface of cover 18 may serve as a support surface 20 for felt 12 as it is guided thereover. Cover 18 may also include a number of separate suction slits 22 and 22' that extend in the travel direction L such that felt 12 is exposed to suction. Further, cover 18 may be formed of wear-resistant material, e.g., ceramic, of non-wear-resistant materials, e.g., plastic, or combinations thereof.

Suction slits 22 and 22' may each be variably adjustable in their length. For example, the lengths of suction slits 22 and 22' may be jointly adjustable, or, alternatively, lengths of least some of the suction slits 22 and 22' may be separately adjustable.

Two groups of slits A and B composed of suction slits 22 and 22', respectively, may be successively or consecutive arranged relative to each other in travel direction L. Each of the groups may extend at least substantially over the entire width of felt 12. Suction slits 22 of group A may be arranged crosswise to travel direction L and offset relative to suction slits 22' of group B.

Figure 2:
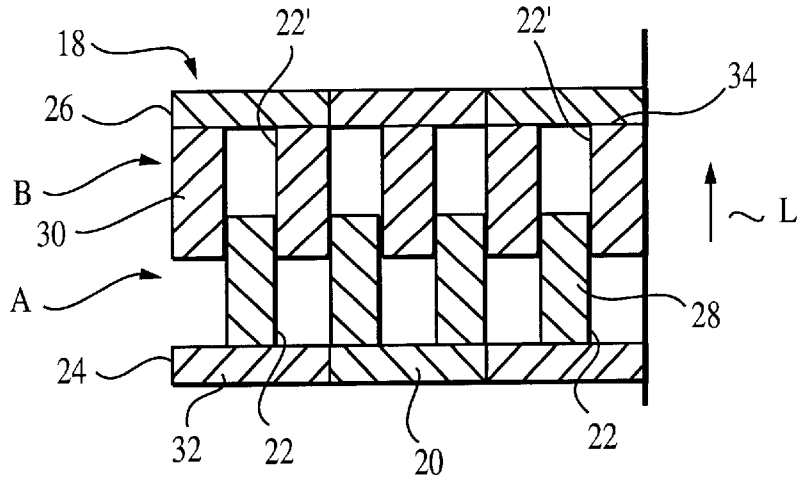
FIG. 2 schematically illustrates a top view of an embodiment, in which the suction slits are formed by two comb-like diaphragms.

As schematically illustrated in FIG. 2, cover 18 may be composed of at least two comb-like diaphragms and, e.g., two comb-like diaphragms 24 and 26, whose respective teeth 28 and 30 extend in travel direction L and are offset relative to each other generally crosswise to travel direction L such that the two comb-like diaphragms mesh or are interlaced with each other, as shown in the exemplary illustration. In this manner, suction slits 22 and 22', respectively, may form groups A and B between comb-like diaphragms 24 and 26. Support surface 20 facing felt 12 (not shown in FIG. 2) may be, consequently, at least partially formed by the surface of teeth 28 and 30 and the surface of backs or crosspieces 32 and 34 of the comb-like diaphragms 24 and 26 adapted to face felt 12.

At least one of the comb-like diaphragms 24 and 26 can be displaceable in travel direction L, e.g., relative to a stationary housing part 36 (see FIG. 1). In the exemplary embodiment, both comb-like diaphragms 24 and 26 may be adjustable. Further, at least one of the comb-like diaphragms 24 and 26 can also be subdivided into a plurality of segments each composed of one or a plurality of teeth 28 and 30. In this manner, at least some of the diaphragm segments can be adjustable, e.g., independently of each other in travel direction L and relative to stationary housing part 36.

FIGS. 3–6 illustrate alternative arrangements for the suction slits in cover 18 over which web 12 is guided. These are alternative arrangements are provided for the purposes of illustration should not to be construed as limiting the features of the present invention to any specific arrangement of the suction slits. Further, the arrangement of group A may be combined with one of the other arrangements from group B which are not explicitly combined in the exemplary figures.

Figure 3:
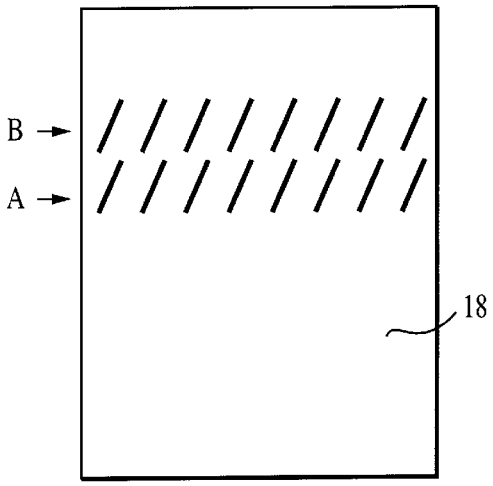
FIGS. 3, 4, 5, and 6 illustrates alternative arrangements for the suction slits.
Figure 4:
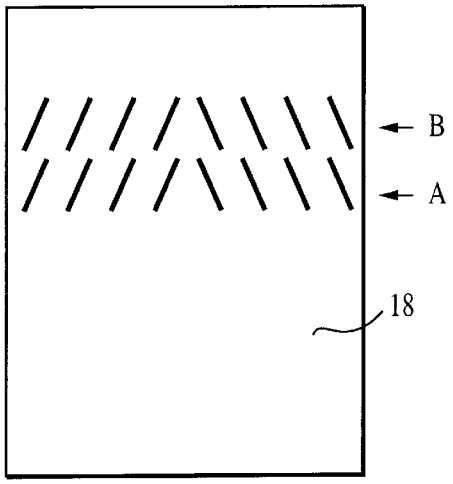
Figure 5:
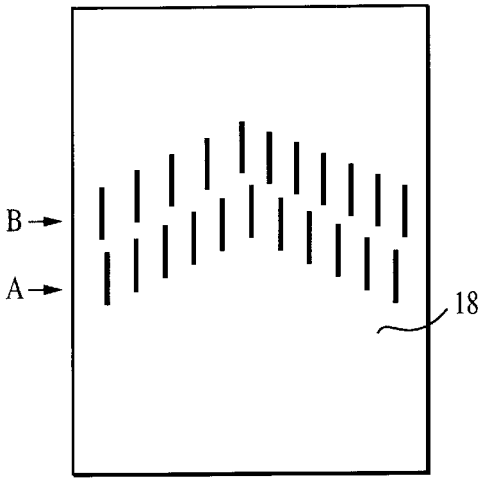
Figure 6:
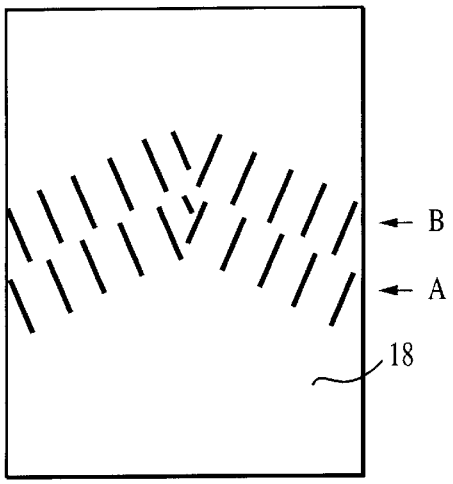

In FIG. 3, the slits in groups A and B are arranged obliquely to the travel direction of web 12. In FIG. 4, the slits in groups A and B are arranged obliquely to the travel direction of web 12 and are arranged in mirror symmetry to a crosswise center of web 12 or the machine width. In FIGS. 5 and 6, groups A and B are arranged to extend obliquely to the travel direction of web 12. In FIG. 5, the suction slits are arranged in the travel direction of web 12, and, in FIG. 6, the suction slits are arranged obliquely to the travel direction of web 12.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 Suction device
12 Felt
14 Housing
16 Vacuum chamber
18 Cover
20 Support surface
22 Suction slit
22' Suction slit
24 Comblike diaphragm
26 Comblike diaphragm
28 Teeth
30 Teeth
32 Back
34 Back
36 Stationary housing part
A Group of slits
B Group of slits
L Direction of travel of the felt

What is claimed:

1. A suction device for at least one of conditioning and drainage of an endless felt comprising:

a housing having at least one vacuum chamber;

a plurality of suction slits located on a suction surface of the housing that is adapted to face the endless felt, and arranged in at least one row across a width of the endless felt;

the plurality of suction slits being oriented to extend at least one of in and obliquely to a travel direction of the endless felt; and the plurality of suction slits in the at least one row being adjustable in length.

2. The suction device in accordance with claim 1, wherein at least some of the plurality of suction slits are variably adjustable in length.

3. The suction device in accordance with claim 2, wherein at least some of the plurality of suction slits are separately adjustable in length.

4. The suction device in accordance with claim 1, wherein at least some of the plurality of suction slits are arranged obliquely to the felt travel direction and arranged in mirror symmetry relative to a crosswise median of the felt.

5. The suction device in accordance with claim 1, wherein at least some of the plurality of suction slits are arranged next to each other into at least one group that extends at least substantially crosswise over at least part of the width of the felt.

6. The suction device in accordance with claim 1, wherein at least some of the plurality of suction slits are arranged into at least one group that extends over at least part of the width of the felt obliquely to the felt travel direction.

7. The suction device in accordance with claim 1, wherein at least some of the plurality of suction slits are arranged into at least two groups that are successively arranged in the felt travel direction.

8. The suction device in accordance with claim 7, wherein the plurality of suction slits are arranged into at least two groups of slits that are successively arranged in the felt travel direction and that are arranged to extend crosswise over at least substantially an entire width of the felt.

9. The suction device in accordance with claim 7, wherein the suction slits of successive groups are arranged offset relative to each other generally crosswise to the felt travel direction.

10. The suction device in accordance with claim 1, wherein at least some of the plurality of suction slits are arranged into at least one pair of groups, wherein the groups of the at least one pair are arranged to extend over at least substantially one-half a width of the felt and obliquely to the felt travel direction, and wherein the groups of the at least one pair are arranged in mirror symmetry relative to a crosswise median of the felt.

11. The suction device in accordance with claim 10, wherein at least two pairs of groups are successively arranged in the felt travel direction, and wherein the groups located on a same side of the crosswise median of the felt and arranged obliquely to the felt travel direction are arranged parallel to each other.

12. The suction device in accordance with claim 1, wherein the plurality of suction slits are arranged into at least two successive groups of slits relative to the felt travel direction, and the device further comprises:

at least two comb-like diaphragms having teeth extending in the felt travel direction;

the at least two comb-like diaphragms are offset from each other in the crosswise direction to form the plurality of suction slits, such that the teeth of one of the comb-like diaphragms are aligned with gaps of an adjacent comb-like diaphragm.

13. The suction device in accordance with claim 12, wherein at least one of the at least two comb-like diaphragms is adjustable in the felt travel direction relative to a stationary portion of the housing.

14. The suction device in accordance with claim 12, wherein at least one of the at least two comb-like diaphragms is subdivided into a plurality of segments, wherein each of the segments is composed of at least one tooth and that at least some of the plurality of segments are adjustable in the felt travel direction relative to the stationary portion of the housing.

15. The suction device in accordance with claim 14, wherein the plurality of segments are at least partially separately adjustable.

16. The suction device in accordance with claim 1, wherein the housing is composed of at least one tube-shaped vacuum chamber that extends crosswise to the felt travel direction and at least substantially over the entire width of the felt.

17. The suction device in accordance with claim 1, wherein the housing is composed of only one vacuum chamber that extends at least substantially over the entire width of the felt.

18. The suction device in accordance with claim 1, wherein the suction device is adapted for use in at least one of a paper and cardboard producing machine.

19. A process for at least one of draining and conditioning an endless belt comprising:

guiding the endless belt over a suction surface of a vacuum chamber;

suctioning a surface of the endless belt with a plurality of suction slits located in the suction surface of the vacuum chamber and arranged in at least one row across a width of the endless belt, wherein the plurality of suction slits extend in a direction that is at least one of in and oblique to a belt travel direction; and adjusting a length of the plurality of suction slits in the at least one row.

20. The process in accordance with claim 19, further comprising:

adjusting a length of at least some of the plurality of suction slits.

21. The process in accordance with claim 19, wherein the plurality of suction slits are arranged in a least two rows that extend across a width of the vacuum chamber, and the process further comprises:

successively suctioning the endless belt in each of the at least two rows.

22. The process in accordance with claim 19, wherein the plurality of suction slits are arranged in a least two rows that extend across a width of the vacuum chamber, and wherein the suction slits of each row are positionally offset in a direction crosswise to the belt travel direction from the slits of the suction slits of an adjacent row, and the process further comprises:

successively suctioning the endless belt in each of the at least two rows.

23. The process in accordance with claim 19, wherein the plurality of suction slits are formed by at least two comb-shaped elements, which are interlaced so that teeth of one of the at least two comb-shaped elements are positioned in gaps of an adjacent comb-shaped element, and the process further comprises:

successively suctioning the endless belt in each of the at least two rows.

24. The process in accordance with claim 23, further comprising:

adjusting the position of the at least one of the comb-shaped elements relative to the adjacent comb-shaped element, whereby a slit length of at least some of the plurality of suction slits is adjusted.

25. The process in accordance with claim 19, wherein the suctioning of the surface of the endless belt with a plurality of suction slits is provided through a plurality of suction slits arranged obliquely to the travel direction of the belt.

26. The process in accordance with claim 19, wherein the suctioning of the surface of the endless belt with a plurality of suction slits is provided through a plurality of suction slits arranged obliquely to the travel direction of the belt, and wherein the plurality of suction slits is arranged in mirror symmetry relative to a center line of the suction surface that extends in the travel direction.

27. The process in accordance with claim 19, wherein the suctioning of the surface of the endless belt with a plurality of suction slits is provided through a plurality of suction slits arranged obliquely to the belt travel direction of the belt, and wherein the plurality of suction slits is arranged in mirror symmetry relative to a center line of the endless belt that extends in the travel direction.

28. A suction device for at least one of conditioning and drainage of an endless felt in a web producing machine comprising:

a housing extending across a machine width that is composed or at least one vacuum chamber;

a plurality of suction slits located on a suction surface of the housing and arranged in at least one row across a width of the endless felt;

the plurality of suction slits being oriented to extend at least one of crosswise to and obliquely to the machine width; and the plurality of suction slits in the at least one row being length adjustable.

29. The suction device in accordance with claim 28, wherein at least some of the plurality of suction slits are variably adjustable in length.

30. The suction device in accordance with claim 28, wherein at least some of the plurality of suction slits are arranged obliquely to the machine width and arranged in mirror symmetry relative to a median of the machine width.

31. The suction device in accordance with claim 28, wherein at least some of the plurality of suction slits are arranged next to each other into at least one group that extends at least substantially over at least part of the machine width.

32. The suction device in accordance with claim 28, wherein at least some of the plurality of suction slits are arranged into at least one group that extends obliquely over at least part of the machine width.

33. The suction device in accordance with claim 28, wherein at least some of the plurality of suction slits are arranged into at least two groups that are successively arranged in a direction crosswise to the machine width.

34. The suction device in accordance with claim 33, wherein the plurality of suction slits are arranged into at least two groups of slits that are successively arranged in the direction crosswise to the machine width and that are arranged to extend over at least substantially over the machine width.

35. The suction device in accordance with claim 33, wherein the suction slits of successive groups are arranged offset relative to each other generally in a direction of the machine width.

36. The suction device in accordance with claim 28, wherein at least some of the plurality of suction slits are arranged into at least one pair of groups, wherein the groups of the at least one pair are arranged to extend over at least substantially one-half the machine width and obliquely to the machine width, and wherein the groups of the at least one pair are arranged in mirror symmetry relative to a median of the machine width.

37. The suction device in accordance with claim 36, wherein at least two pairs of groups are successively arranged in a direction crosswise to the machine width, and wherein the groups located on a same side of the median of the machine width and arranged obliquely to the machine width are arranged parallel to each other.

38. The suction device in accordance with claim 28, wherein the plurality of suction slits are arranged into at least two successive groups of slits relative to a direction crosswise to the machine width, and the device further comprises:

at least two comb-like diaphragms having teeth extending in the direction crosswise to the machine width; and the at least two comb-like diaphragms are offset from each other in the direction of the machine width to form the plurality of suction slits, such that the teeth of one of the comb-like diaphragms are aligned with gaps of an adjacent comb-like diaphragm.

39. The suction device in accordance with claim 38, wherein at least one of the at least two comb-like diaphragms is adjustable in the direction crosswise to the machine width and relative to a stationary portion of the housing.

40. The suction device in accordance with claim 38, wherein at least one of the at least two comb-like diaphragms is subdivided into a plurality of segments, wherein each of the segments is composed of at least one tooth and that at least some of the plurality of segments are adjustable in the felt travel direction relative to the stationary portion of the housing.

* * * * *